US005522761A

United States Patent [19]

Lessard

[11] Patent Number: 5,522,761

[45] Date of Patent: Jun. 4, 1996

[54] RADIAL GRIP REMOTE CONTROL FOR ABRASIVE BLAST MACHINES

[76] Inventor: Michael A. Lessard, P.O. Box 263, Oakland, Me. 04963-0263

[21] Appl. No.: 278,819

[22] Filed: Jul. 21, 1994

[51] Int. Cl.[6] ..... B24B 31/00

[52] U.S. Cl. ..... 451/102; 451/99; 451/101; 451/90

[58] Field of Search ..... 451/99, 101, 90, 451/75, 102; 251/231, 243–246; 137/454.2

[56] References Cited

U.S. PATENT DOCUMENTS

| | | | |
|---|---|---|---|
| 1,367,570 | 2/1921 | Sykes | 251/245 |
| 1,876,718 | 4/1929 | McPherson . | |
| 3,201,901 | 8/1965 | Pauli | 451/75 |
| 3,405,732 | 10/1968 | Dow | 137/454.2 |
| 3,690,558 | 9/1972 | Tuttle | 239/127 |
| 4,585,168 | 4/1986 | Even et al. | 239/74 |
| 4,655,492 | 4/1987 | Landry | 294/15 |
| 4,821,467 | 4/1989 | Woodson et al. | 451/99 |
| 4,901,928 | 2/1990 | Abbott et al. | 451/102 |
| 4,926,589 | 5/1990 | Abbott et al. | 451/90 |
| 4,932,592 | 6/1990 | Abbott et al. | 451/90 |
| 4,968,940 | 11/1990 | Clark et al. | 324/338 |
| 5,165,451 | 11/1992 | Goldsmith | 137/454.2 |

OTHER PUBLICATIONS

A–BEC by Clemco.
Key Houston, by Lindsay.
Sanstorm, by Schmidt.
Western Technology.

*Primary Examiner*—Bruce M. Kisliuk
*Assistant Examiner*—Derris Banks

[57] ABSTRACT

A radial grip remote control for the operation of abrasive blast machines. The handle of the grip is permanently attached to a linear bearing. The bearing utilizes the abrasive blast hose as a journal, and may be rotated manually by adjusting the radial position of the handle. The inside diameter of the bearing is adjustable. The adjustment is intended to allow the bearing to rotate freely about its journal (hose), and to cause seizure of the bearing to this journal when the hose is pressurized. The steel handle acts as a protective housing for a positive shut-off type valve which is internally installed. The remote control is designed to be ergonomically accommodating and to increase the safety of abrasive blasting operations. The base of the handle comprises a female connecting socket for adaptation to automated or remotely operated abrasive blast systems.

15 Claims, 2 Drawing Sheets

RADIAL GRIP REMOTE CONTROL FOR ABRASIVE BLAST MACHINES

BACKGROUND—FIELD OF INVENTION

This invention relates to Abrasive Blasting Operations, specifically to remote controls which are used by Blast Operators to control abrasive blast machines.

BACKGROUND —DESCRIPTION OF PRIOR ART

For several decades, conventional abrasive blast machines have remained almost completely unchanged. Most designs in use today are about thirty years old, and are relatively simple. In order to market competitively, the greatest engineering efforts were placed in the most critical areas of the machines. Remote controls, being simple devices, were apparently not of high priority to engineers. Little thought was directed toward the Blast Operator who must use the control daily. Prior controls are electric switches or pneumatic valves, mounted controls are electric switches or pneumatic valves, mounted longitudinally on the nozzle end of the blast hose. They are rigidly fastened, and do not do not offer adjustment of radial positioning. They are actuated by a lever which is also mounted in this parallel fashion. You will observe these configurations in the U.S. Pat. Nos. 3,201,901 (mfrd. by Pauli and Griffin), and U.S. Pat. No. 4,968,940 (mfrd. by SAN-BLAST). Furthermore, you will witness these configurations in the prior art of A-BEC, Clemco, Key Houston, Lindsay, SANSTORM, Schmidt, and Western Technology.

This configuration does not lend itself to the anatomy of the Blast Operator. The Operator must place both hands on the hose, one behind the other, with part of the rearward hand extended to manipulate the control lever. During blast operations a great deal of force is exerted through the nozzle, which must be absorbed by the Operator. The Operator must also support significant weight and manipulate a very stiff, large diameter hose. Prior control configurations do not allow a comfortable, safe, and stable holding grip for the Operator. As a result, the industry is plagued with repetitive motion injuries, tendonitis, carpal tunnel syndrome, and insurance claims.

In the race to compete in current markets, manufacturers must produce large, sophisticated equipment for removing lead paint from bridges, structures, ships, etc. Once again, the remote control is not of high priority, and is left unchanged.

The prior art of A-BEC reveals a narrow base which is attached longitudinally to the blast hose with zip-ties or metal hose clamps.

The prior art of Schmidt Mfg. reveals a plastic body with a shuttle valve. This control is compact, but consequently has a tiny valve which freezes rapidly in operations at temperatures approaching zero degrees Celsius. Furthermore, the trigger interlock (a button that interferes with trigger movement until depressed) is a disadvantage because any slight or unreasonable release will engage the interlock. This causes great levels of discomfort to the Operator because the trigger must be tightly held to the full extent of travel. Each time the trigger is inadvertently released, a lag period is caused by the repressurization of the system.

Reviewing the prior art, the reader will observe, several devices durably constructed, while others are seriously deficient to the physical abuse of abrasive blasting. Most are similar to that of Schmidt, namely the trigger interlock engages upon the unreasonably minimal release of the trigger.

The prior art of Clemco is well executed in its reliability, as the valve is simply a vent hole in the body, which is opened or closed by a rubber plug mounted to the bottom surface of the trigger. When the trigger is depressed, the plug blocks the vent, causing pressure to build and start the blast machine. When released, the control pressure is vented and the machine shuts off. However the design is one which consumes excessive energy, as it only vents pressure to stop the blast machine, but does not shut-off compressed air supplied to the control. When the system is off, a large volume of air blows constantly into the work environment, consuming fuel and creating dust, an environmental safety hazard to workers.

In all above cases, the remote controls are attached to the blast hose using plastic zip ties or metal hose clamps. This method of attachment fails to facilitate radial movement of the control around the outside surface of the blast hose. Blast hoses are large, heavy, and stiff. Each time the Operator takes a step or changes the holding position, an aggressive twisting moment occurs in the hose. Consequently, the control is rarely in the correct radial position for Operator comfort and safe manipulation.

OBJECTS AND ADVANTAGES

Accordingly, several objects and advantages of my invention are:

(a) To provide a control that obviates the natural human anatomy and the natural positioning of the hand, wrist and arm; ergonomic design to enhance Operator ease.

(b) To provide linear bearing method of attachment to the blast hose to compensate for the twisting moment of the hose, and to enhance Operator comfort;

(c) To provide a remote control which lends itself to the reduction of repetitive motion injuries, insurance claims, and lost production time;

(d) To provide increased long and short term safety of abrasive blasting operations by increasing stability, decreasing dust and eliminating constant compressed air discharge at the remote control;

(e) To provide a large, ergonomically correct trigger with vertical orientation and elliptical travel for drainage of trapped abrasive media;

(f) To provide a trigger safety interlock that engages only upon full release of the trigger;

(g) To provide energy savings by using a positive shut-off type control valve;

(h) To provide a full flow valve for faster start-up and shut-down of blast machines, and decreased tendency to freeze;

(i) To provide the durability and reliability of welded steel construction;

(j) To provide maximum protection of critical working components by effectively sheltering them inside a steel handle;

(k) To provide a remote control that retrofits all existing types and one that comprises built-in fittings for easy adaptation to automated, robotic, or remotely operated blast machinery;

(l) To provide a remote control which is highly visible in the blast room due to its configuration and bright colors;

(m) To provide a remote control which maximizes the potential efficiency of the human element.

Further objects and advantages of my invention will become apparent from a consideration of the drawings and ensuing description.

DRAWING FIGURES

Figure 1:
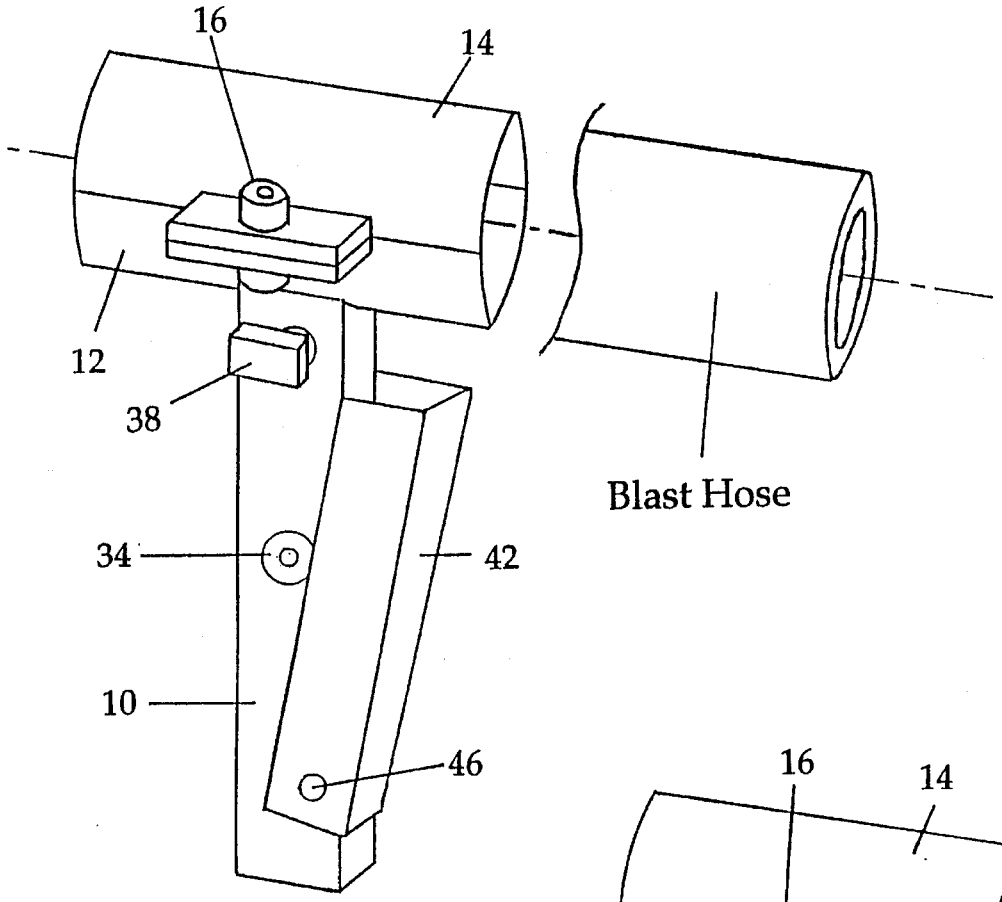
FIG. 1 shows a view of the remote control from the right front corner.

| Reference Numerals in Drawings | |
|---|---|
| 10 handle | 12 lower bearing |
| 14 upper bearing | 16 socket head capscrew |
| 18 support cartridge | 20 valve body |
| 22 valve stem | 24 stem seal |
| 26 o-ring | 28 u-seal |
| 30 conical spring | 32 set screw |
| 34 spring plunger | 36 trigger return spring |
| 38 inlet connector | 40 discharge connector |
| 42 trigger | 44 sealing disc |
| 46 grooved dowel | |
| 96 bearing assembly | 98 valve assembly |

DESCRIPTION—FIGS. 1 TO 3

Figure 2:
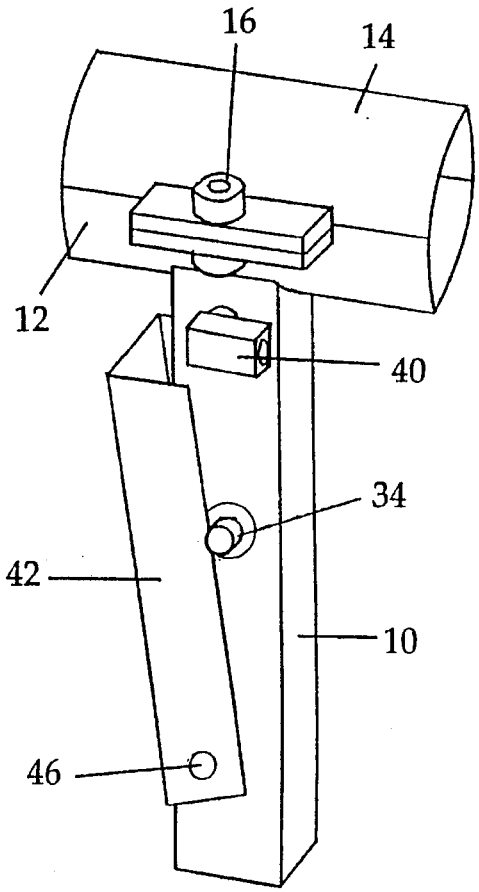
FIG. 2 shows a view of the remote control from the left rear corner.

A typical embodiment of my invention is illustrated in FIG. 1 (right front) and FIG. 2 (left rear). Several processes and various materials may be utilized in the manufacture of the structure and internal parts. For instance, a handle 10, bearing assembly 96, and trigger 42 could be cast or formed of various metals or plastics, in one or more pieces. In the preferred embodiment, they are fabricated of steel, and all non-moving attachment points are welded. This provides maximum structural durability.

Figure 3:
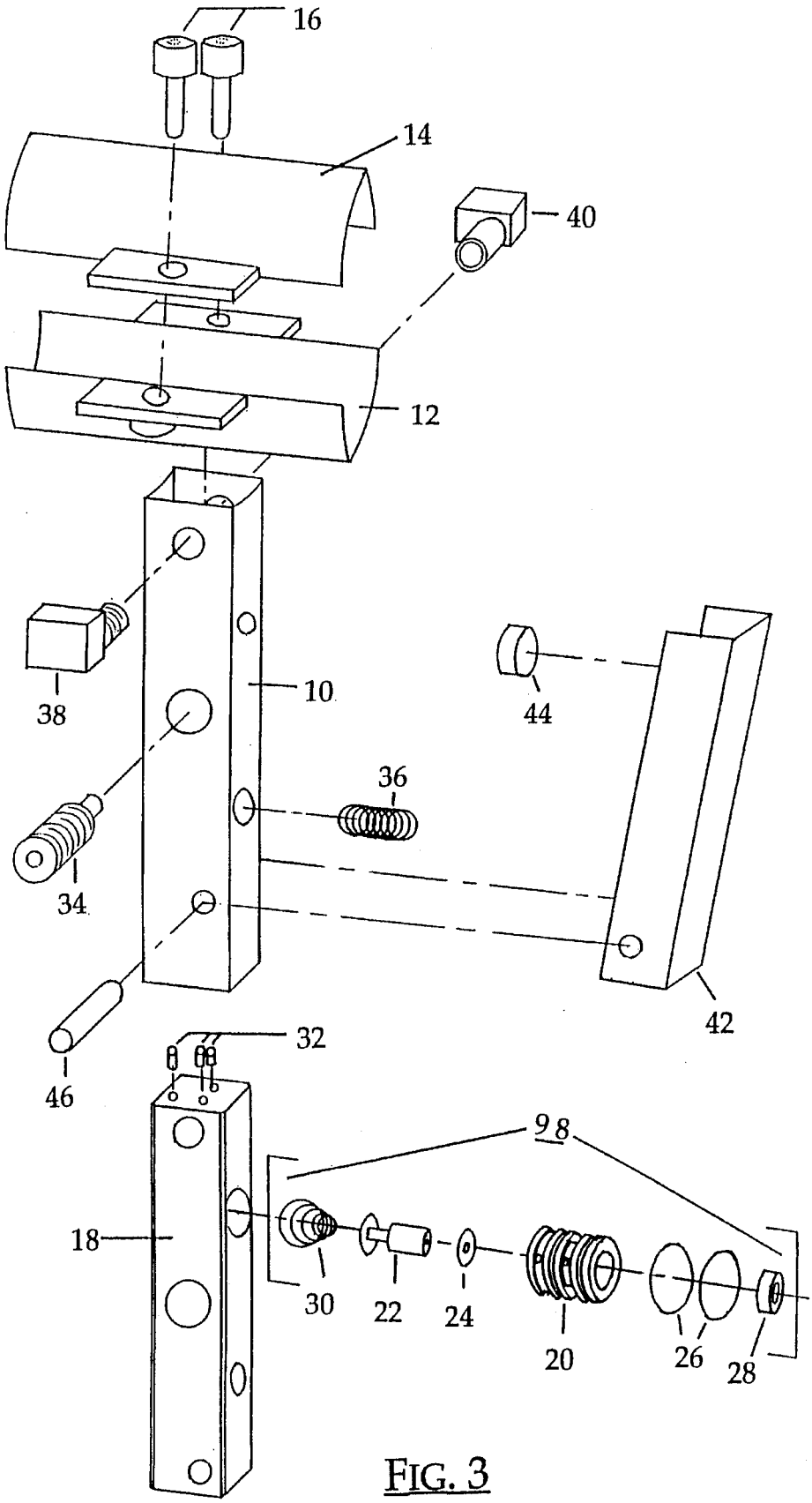
FIG. 3 shows an exploded view from the right front.

Due to the sophistication of internal parts, I have provided FIG. 3 (exploded view), and to further simplify, have drawn lower bearing 12 and upper bearing 14 in their fabricated forms. I would like to discuss these two parts in detail to explain how they are fabricated from the raw materials.

The semi-cylindrical portions of the bearing assembly 96 are cut from a length of round steel tube. The tube is then split to form two nearly identical half round shapes and all edges are deburred. To fabricate upper bearing 14, two fastening tabs are cut or stamped from a length of steel strip, and a hole is drilled through the center. These tabs are then welded to the lower outside edges of the bearing. The remaining half round shape becomes the lower bearing 12. Fabrication is similar to the first bearing, except that a self-clinching nut is pressed and welded into each of the center holes.

A handle 10 is cut from a length of mechanical grade square steel tube. Several precisely located holes are drilled in the tube for the fitting of the remaining components of the remote control. Front and rear upper edges of the handle 10 are radially cut to closely fit the radius of the bearing 12, and the two are joined at right angles by welding.

Although many industrial plastics are suitable materials for a support cartridge 18, the preferred embodiment is PTFE reinforced acetal. The cartridge 18 is cut to length and sized to fit inside the handle 10 with minimal resistance on installation. The outside corners are chamferred to alleviate interference with the inside corners of the handle 10. Additional machining of the cartridge 18 involves drillings, borings and chamfers. These are the air inlet bore, air discharge bore, inlet air passage and crossover, discharge air passage, valve body bore and chamfer, spring plunger bore (tapped and threaded), trigger return spring bore and chamfer, and grooved dowel bore.

A valve body 20 can also be manufactured of a variety of materials, namely industrial plastics or metals. The preferred embodiment is high tensile aluminum. The valve body 20 has three different inside diameter borings throughout its length. The rearward most bore, being the largest, is slightly larger than the outside diameter of the flange portion of a valve stem 22 and is deep enough to accommodate its full stroke plus the wire diameter of a conical spring 30. The bottom face of this counterbore is flat and finished to provide a seating surface for a stem seal 24. Through the central portion of the valve body 20 is a bore which is slightly larger than the diameter of the valve stem (large front portion). This portion acts as a cylinder for the stroking and alignment of the valve stem 22. The front portion of the valve body 20 is a gland and is bored to accept a u-seal 28 for the sealing of the valve stem 22. The outside diameter of the valve body 20 is consistent throughout its length, with the exception of four machined grooves of smaller outside diameters. The rearward most groove is an inlet air passage. When the valve body 20 is installed in its respective bore in the support cartridge 18, this groove is in alignment with the inlet air passage discussed earlier. The second from rearward groove is a gland which is fitted with an o-ring 26. The third from rearward groove is a discharge air passage which aligns with its respective discharge air passage in the support cartridge 18. The forward most groove is a gland which is fitted with an o-ring 26.

The depth of the valve body bore in the support cartridge 18 is equal to the overall length of the valve body 20. When a valve assembly 98 is installed in the support cartridge 18, the front faces are flush and:

(a) the conical spring 30 is initially loaded due to the clearance between the bottom of its respective bore and the mandreled flange of the valve stem 22;

(b) the stem seal 24 is seated between the flange of the valve stem 22 and its respective seat in the valve body 20. (The stem seal 24 is mechanically bonded to the flange by use of adhesives);

(c) The valve stem 22 protrudes beyond the front faces of the cartridge 18 and the valve body 20;

(d) The front face of the u-seal 28 is flush with the front face of the valve body 20;

(e) The o-rings 26 are installed and compressed between the outside diameter of their respective glands and the inside diameter of the valve body bore in the cartridge 18;

With the valve assembly 98 installed in the support cartridge 18, the later is installed into the handle 10 by fully depressing the valve stem 22, and inserting the cartridge 18 upwards until the valve stem 22 protrudes through its respective hole in the handle 10. At this point, all remaining holes in the handle 10 and cartridge 18 will be in alignment for installation of the remaining components.

An inlet connector 38 is threaded into the inlet bore on the right side of the handle 10. Likewise, a discharge connector 40 is threaded into the discharge bore on the left side.

A spring plunger 34 is threaded into its respective bore in the central portion of the handle 10. This part may be started from either the left or right side in order to suit right or left handed Blast Operators.

A trigger return spring 36 is inserted into its chamferred bore in the front face of the handle 10. When a trigger 42 is installed to the handle 10 with a grooved dowel 46, the return spring 36 becomes initially loaded. The trigger 42 may be manufactured by various methods and materials. The preferred embodiment is to stamp the basic shape from a flat steel plate, and then form it over a die. The three sided embodiment serves as a protective guard to the valve stem 22 and a sealing disc 44.

The sealing disc 44 is bonded with adhesives to the rear face of the trigger 42, at a position aligned with the front face of the valve stem 22.

From the description above, a number of advantages of my radial grip remote control become evident:

(a) radial grip accommodates ergonomics and correct anatomical holding position for the Blast Operator, as the hand, wrist and arm are in a natural position;

(b) the linear bearing method of attachment to the blast hose allows the remote control to rotate freely, to compensate for the twisting moment of the hose. This enables the Operator to select any desired radial position of the control, and to change this radial position instantly as needed to suit comfort and safety;

(c) maximized ergonomics, comfort and ease of use results in significant reduction in repetitive motion injuries, insurance claims and lost production time;

(d) increased short and long term safety of blast operations, due to comfortable and stable holding positions, elimination of constant compressed air discharge at the remote control, and decreased dust in the blast room;

(e) large radially oriented trigger is mounted on the front of the handle for proper pulling position. Elliptical trigger swing causes trapped abrasive to drain when the trigger is depressed;

(f) trigger safety interlock engages only upon full release of the trigger. This affords the Operator a more relaxed hold as it eliminates effort to maintain full depression of the trigger. Most prior art trigger interlocks engage upon "hair" release of the trigger. My design significantly reduces lag time caused by frequent inadvertent trigger release;

(g) energy saving positive shut-off valve eliminates constant venting of compressed air at the remote control. This not only saves fuel, but enhances safety and health by eliminating constant air discharge and reducing dust;

(h) high flow rate of the valve produces faster start-up and shut-down (pressurization and depressurization) of blast machine and has less tendency to freeze in temperatures approaching zero degrees Celsius;

(i) all welded steel construction provides maximum durability and reliability. Prior art is deficient;

(j) no exposed critical components. All working parts are housed within the steel handle where they are not subject to the rebound of blasting sands and media and cannot be damaged by abrasion or impact of foreign objects;

(k) very simple installation retrofits all existing remote controls and comprises built-in fittings for easy adaptation to automated, robotic and remotely operated systems;

(l) radial configuration and bright colors are highly visible for increased blast room safety;

(m) basis of the invention is to maximize the potential of the human element in abrasive blasting operations. I have accomplished this with a device that reduces fatigue, injuries and discomfort, while greatly enhancing production.

DESCRIPTION OF OPERATION—FIGS. 1, 2 AND 3

I am initially basing my discussion of operations of my invention in the preferred embodiment. Therefore, theory of operation is the control of the flow of compressed air by the use of a series of valves, vents and air passages. The remote control is used to start and stop abrasive blast machines.

To install, remove a pair of socket head capscrews 16 that retain the bearing assembly 96, FIG. 3. Place the blast hose in the lower bearing 12. Install the upper bearing 14 over the blast hose and install the two socket head capscrews 16. Tighten evenly until the remote control seizes on the blast hose, then back them off, each one half turn. This adjustment will enable the bearing 96 to rotate freely about the hose and will cause the bearing 96 to seize when the hose is pressurized. Install the existing inlet air line to the inlet connector 38 and the existing discharge air line to the discharge connector 40. This completes installation.

The bearing 96, FIG. 1; is designed to substantially support itself on the blast hose and to rotate freely (system OFF), or seize completely to its journal (system ON). These events are established by the adjustment of the socket head capscrews 16, FIG. 3. Rotation is accomplished manually by moving the permanently attached handle 10, FIG. 1 to the desired radial position.

As illustrated in FIG. 3, the handle 10 houses a support cartridge 18, which in turn, houses a valve assembly 98. The support cartridge 18 is comprised of a series of inlet and discharge air passages. A supply of compressed air enters the inlet passage through an inlet connector 38 and is transported to a valve body 20. A trigger 42 is used to operate the control. When the trigger 42 is depressed, a valve stem 22 is forced rearward to disengage from its seat. Compressed air then flows through an air passage in the central portion of the valve body 20 and exits into the discharge air passage of the cartridge 18. The air is then transported out of the remote control through a discharge connector 40. This discharge air flow ultimately terminates at the blast machine and provides the energy by which it is operated.

To elaborate on this discussion of installation and operation, I will further explain the details and functions of the individual parts. In order to simplify this, I will proceed in the order of air flow, with reference to FIG. 3. The inlet connector 38 and discharge connector 40 are standard ⅛ inch by ⅛ inch by ninety degree national pipe thread street elbows. Their purpose is to couple the existing twin line air hoses to the remote control. The support cartridge 18 serves two functions. First to support components and secondly to provide passages for the movement of compressed air through the remote control. Due to limited space, the inlet air passage is comprised of two drillings, including a main passage and a crossover passage. These allow passage of air from the inlet connector 38 to the valve body 20. The tops of the passages are blocked with set screws 32 to prevent the escape of air. The outside diameter of the valve body 20 is fitted with two o-rings 26. The rearward o-ring prevents air from bypassing the valve stem 22 via the outside surfaces of the valve body 20. When the valve is closed, compressed air cannot pass the valve stem 22.

When the trigger 42 is depressed, two separate air control functions are initiated. First, a sealing disc 44 blocks a vent passage in the valve stem 22 which prevents air from escaping through the same. Secondly, the valve stem 22 is displaced rearward, which causes a reinforced rubber stem seal 24 to disengage the seating area of the valve body 20. This allows air to flow through the center section of the valve body 20 and into the discharge passage of the cartridge 18. The central section of the valve body 20 comprises a bore which is slightly larger than the outside diameter of the valve stem 22. This arrangement facilitates the smooth stroking of the valve stem 22 through the valve body 20. The smaller center section of the valve stem 24 creates the air passage through the valve body 20 center section. The front o-ring 26 seals air from escaping around the outside surface of the valve body 20. A u-seal 28 seals the valve stem 22.

To stop the blast machine, the trigger 42 is released. Again, two separate air control functions are initiated, in reverse of the above description. First, the valve stem 22 and seal 24 are seated in the valve body 20, which stops the supply of compressed air. Secondly, the sealing disc 44 disengages the vent passage in the valve stem 22, which causes control pressure to vent from the blast machine through the valve stem 22. This venting of control pressure causes the blast machine to stop.

When released, the trigger 42 is returned to the standby position by a trigger return spring 36. A conical spring 30 initiates the positive return of the valve stem 22. When the trigger 42 is retracted to the full extent (standby position), a spring plunger 34 engages to prevent inadvertent activation. In order to depress the trigger 42, the Operator must first depress the spring plunger 34 to clear the interference, and then continue to depress the trigger 42.

The trigger 42 pivots from the axis of a grooved dowel 46. Full radius of travel is eleven degrees, with retraction limited by interference of the bottom front edge of the trigger 42 and the front face of the handle 10.

In other embodiments, the handle 10 does not comprise drillings for pneumatic components, nor does the support cartridge 18. Instead, these are fitted with electric switching components, preferably proximity switches.

The sensing face of the proximity switch is configured flush with the front face of the handle 10, in a position inside the travel radius of the trigger 42. The sealing disc 44 is eliminated. The steel trigger becomes the target. When the trigger 42 is depressed, the switch detects its presence and turns the blast machine on. When released, the sensor no longer detects a target and the machine is turned off. In this embodiment, a closed cell foam disc is attached to the sensing face of the proximity switch to protect the sensing face and to prevent inadvertent activation by detection of steel particles during steel grit and steel shot blasting operations.

Another embodiment is to use the device in automated, robotic or remotely operated abrasive blasting systems. This is accomplished by inserting a male fixture into the existing female base of the handle 10 and securing with a fastener. Either pneumatic or electric embodiments may be used in this manner. The blast hose is supported in the same way as it is described above. The only difference is that the handle 10 is used as a fixturing interface to the mechanical apparatus of the automated systems.

SUMMARY, RAMIFICATIONS, AND SCOPE

Accordingly, the reader will see that the radial grip remote control of this invention is not only an ergonomically correct device suiting the anatomy of the operator. The remote control allows the operator to select and easily change the desired radial position of the remote control for maximum comfort and control. The design is accomplished by the bearing method of attachment to the blast hose.

Another important advantage is short and long term safety. Operator safety is enhanced by the type and adjustability of the grip. The Operators control and manipulation of the blast hose immediately improves and significantly reduces repetitive motion injuries. These injuries are caused by conventional "in line" remote controls that require both hands, one behind the other to grip the hose and control. Furthermore, the radial grip remote control has additional advantages such as:

* a feeling of reduced weight due to increased holding power and leverage;
* improves production rates over all prior art, and is specifically designed to maximize the potential of the Operator;
* the positive shut-off valve is energy efficient and safer in the workplace because it does not continuously vent compressed air when in the standby (off) position;
* the configuration and bright colors of the remote control make it highly visible in the blast room;
* all critical components are housed within the steel handle to prevent damage and to increase reliability;
* user friendly trigger interlock;
* full flow valve for faster start-up and shut-down of blast machine;
* retrofits all existing controls, and
* comprised of built-in fittings to facilitate adaptation to automated systems.

Although the description above contains many specifities, those should not be construed as limitations on the scope of the invention, but rather as an exemplification of one preferred embodiment thereof. Many other variations are possible. For example, the handle can be different lengths, shapes, colors, or configurations. The bearing system could be lined or could utilize alternate means of adjustment. Electric and pneumatic devices could be used simultaneously in the remote control, etc.

Thus the scope of my invention should be determined by the appended claims and their legal equivalents, rather than by the examples given.

I claim:

1. A remote control of the type whereby abrasive blast machines are operated, the improvement wherein comprising:

(a) a linear bearing wherein comprising two semicylindrical portions arranged to form a cincture, adjustively fastened whereby an inside diameter of said bearing is substantially adjustable;

(b) said adjustable bearing whereby facilitates compensation for substantially unequal diameters of said bearing with respect to the diameter of a journal, and facilitates free movement of said bearing radially about and longitudinally along said journal, and complete seizure of movement of said bearing radially about and longitudinally along said journal (c) means of adjusting said inside diameter of said bearing;

(d) a handle wherein comprising an interior portion thereof, rigidly joined to said linear bearing, said handle oriented substantially perpendicular to longitudinal axis of said bearing;

(e) a valve wherein comprising a slidably movable, resilient seated valve stem, a valve stem guide, and a seating flange, wherein said valve may be opened or closed;

(f) said valve mounted integrally within said interior portion of said handle by means of a support cartridge, said cartridge comprising a receptacle for said valve, a first conduit for conveyance of liquid or gas to inlet of said valve, and a second conduit for conveyance of liquid or gas from the outlet of said valve, said conduits further communicating with the operating controls of an abrasive blast machine;

(g) means of operating said slidable valve stem whereby causing a plurality of functions, specifically, opening of said valve causes said abrasive blast machine to start and said bearing to seize to said journal, and upon closure of said valve, operation of said abrasive blast machine and discharge from said blast hose is completely disabled and said seizure of said bearing to said journal is released;

(h) means of precluding inadvertent operation of said valve.

2. The bearing of claim 1 wherein said cincture arrangement additionally facilitates positive captivation of said bearing to said journal, whereby precluding premature or inadvertent release of said bearing from said journal.

3. The bearing of claim 1 wherein said bearing utilizes an abrasive blast hose as said respective journal.

4. The bearing of claim 1 wherein means of said adjustability is comprised of threaded fasteners whereby said fasteners communicate with said semicylindrical portions causing substantially variable limitations of said inside diameter of said cincture.

5. The valve of claim 1, said valve comprises said valve stem fitted with a resilient seating disc and a one piece valve body wherein said valve body includes said valve stem guide and said seating flange, whereby said resilient seating disc compensates for wear and misalignment of said valve stem and said valve stem guide without loss of sealing capability.

6. The valve of claim 1 wherein said means of operating said slidable valve stem comprises a manually manipulated trigger wherein said trigger communicates directly with said valve stem.

7. The trigger of claim 6 wherein said trigger is pivotally fastened to said handle whereby movement of said trigger is in an elliptical pattern, whereby creating a opening for drainage of foreign materials deposited in proximity to said trigger.

8. The valve of claim 6 wherein means of precluding inadvertent operation of said valve comprises a spring plunger installed within a bore in said handle whereby a spring loaded nose of said spring plunger protrudes to cause interference with movement of said trigger, whereby said plunger nose must be manually depressed in order to move said trigger, and wherein said trigger must be fully released in order to reengage interference of said spring loaded plunger nose.

9. A pressure control valve of the type which functions as a pilot valve whereby a mechanical process is controlled, the improvement wherein comprising:

(a) a handle wherein comprising an interior portion thereof, said handle whereby functions as a hand grip for grasping by a human being;

(b) a valve assembly mounted integrally within said interior portion of said handle by means of a support cartridge, said support cartridge comprising a receptacle whereby receiving said valve assembly, an inlet passage for conveyance of fluid from an inlet connector to an inlet portion of said valve assembly, and a discharge air passage for conveyance of said fluid from a discharge portion of said valve assembly to a discharge connector, said valve assembly is movable to an open or a closed position;

(c) means of operating said valve assembly;

(d) means to preclude inadvertent operation of said valve assembly;

(e) a linear bearing wherein comprising two semicylindrical portions arranged to form a cincture, adjustively fastened whereby an inside diameter of said linear bearing is substantially adjustable;

(f) said linear bearing wherein said linear bearing utilizes a flexible hose as its respective journal;

(g) said linear bearing wherein said adjustability facilitates unlimited free movement of said linear bearing with respect to said journal when said journal is in a non-pressurized state, and further facilitates complete seizure of said linear bearing to said journal when said journal is in a pressurized state, said adjustability of said linear bearing further facilitates compensation for substantially unequal diameters of said linear bearing with respect to diameter of said journal;

(h) said linear bearing wherein said linear bearing is joined to said handle, said handle oriented substantially perpendicular to a longitudinal axis of said linear bearing.

10. The valve assembly of claim 9 wherein said valve assembly comprises a slidably movable valve stem fitted with a resilient seating disc, and a one piece valve body, said valve body includes a valve stem guide and a seating flange, whereby said valve assembly is slidably movable to facilitate opening and closure of said valve assembly.

11. The valve assembly of claim 10 wherein said resilient seating disc compensates for wear and misalignment of said valve stem and said valve stem guide without loss of sealing capability.

12. The valve assembly of claim 10 wherein said means of operating said valve assembly comprises a manually manipulated trigger wherein said trigger is pivotally fastened to said handle, whereby said trigger communicates directly with said slidably movable valve stem to cause opening and closure of said valve assembly.

13. The valve assembly of claim 12 wherein said means of precluding inadvertent operation of said valve comprises a spring plunger installed within a bore in said handle whereby a spring loaded plunger nose of said spring plunger protrudes to cause interference with movement of said trigger, whereby said plunger nose must be fully depressed in order to move said trigger, and wherein said trigger must be fully released in order to reengage interference of said spring loaded plunger nose.

14. The valve assembly of claim 9 wherein said inlet connector and said discharge connector further communicate with the operational controls of an remotely operated machine, the operating of said valve assembly whereby causing a plurality of functions, specifically, opening of said valve causes said remotely operated machine to start and simultaneously causes seizure of said linear bearing to said journal, and upon closure of said valve, operation of said remotely operated machine is completely disabled and seizure of said linear bearing to said journal is released, facilitating unlimited free movement of said linear bearing with respect to said journal.

15. The linear bearing of claim 7 wherein said means of adjustability is comprised of threaded fasteners whereby said threaded fasteners communicate with said semicylindrical portions causing substantially variable limitations of said inside diameter of said cincture.

* * * * *